United States Patent [19]

Spitaler

[11] 4,441,733

[45] Apr. 10, 1984

[54] ADJUSTING MECHANISM FOR A SKI BINDING JAW

[75] Inventor: Engelbert Spitaler, Wr. Neudorf, Austria

[73] Assignee: TMC Corporation, Baar, Switzerland

[21] Appl. No.: 327,390

[22] Filed: Dec. 4, 1981

[30] Foreign Application Priority Data

Dec. 19, 1980 [AT] Austria ..... 6197/80

[51] Int. Cl.[3] ..... A63C 9/22

[52] U.S. Cl. ..... 280/633

[58] Field of Search ..... 280/633, 636, 607, 618; 24/68 A, 344, 345; 403/104, 107, 380

[56] References Cited

U.S. PATENT DOCUMENTS

| | | | |
|---|---|---|---|
| 3,785,666 | 1/1974 | Pierre | 280/633 |
| 3,807,748 | 4/1974 | Ramillon | 280/633 |
| 3,913,931 | 10/1975 | Kratky | 280/633 |
| 3,950,001 | 4/1976 | Weigl | 280/633 |
| 4,022,493 | 5/1977 | Weigl | 280/633 |

FOREIGN PATENT DOCUMENTS

| | | | |
|---|---|---|---|
| 276180 | 2/1969 | Austria | 280/633 |
| 550591 | 6/1974 | Switzerland . | |

*Primary Examiner*—David M. Mitchell
*Assistant Examiner*—Timothy Roesch
*Attorney, Agent, or Firm*—Flynn, Thiel, Boutell & Tanis

[57] ABSTRACT

A mechanism for adjusting the position of a ski binding jaw on a ski includes a guide rail which is secured to a ski and which has a pair of spaced guideways and a serrated strip therebetween extending parallel to the ski. The base plate of the binding is longitudinally movably supported on the guideways and has two longitudinally spaced extensions which extend downwardly between the guideways. A spring and a locking element having a recess and a tooth system thereon are provided between the guideways and between the base plate extensions, the locking element being supported for transverse movement between a first and second position in which its tooth system is respectively engaged with and free of engagement with the serrated strip on the guide rail. The spring urges the locking element toward the first position. The base plate has an opening which is substantially aligned with the recess in the locking element.

16 Claims, 9 Drawing Figures

ADJUSTING MECHANISM FOR A SKI BINDING •JAW

FIELD OF THE INVENTION

This invention relates to an adjusting mechanism for a jaw and, more particularly, to an adjusting mechanism for a front jaw of a safety ski binding which is arranged on a base plate which is supported on two lateral guideways of a ski-fixed guide rail for movement longitudinally of the ski, which guide rail has a serrated strip which extends longitudinally and can releasably engage a tooth system provided on a locking part which is movable transversely of the ski against the force of a spring, a portion of the spring being supported on the locking part.

BACKGROUND OF THE INVENTION

An adjusting mechanism of the above-mentioned type is illustrated for example in Austrian Patent No. 330 633 (which corresponds to U.S. Pat. No. 4,022,493). In this known design, a locking part which extends through recesses in the guide rail carries at least one serrated strip which can be engaged or disengaged from outside with a serrated strip provided on a stepping plate which is coupled with the base plate of the jaw. Also, it is possible in the case of such a jaw to support the locking part on the base plate, whereby a serrated strip is then provided on the guide rail. An important disadvantage of this adjusting mechanism is that structural changes to the guide rail or the base plate are needed, which require reinforcement of these structural parts in the area of the locking piece, thereby causing the entire adjusting mechanism to be expensive to build. Even though the spring which biasses the locking part can be selected to be relatively weak, as compared to springs of other known adjusting mechanisms, it nevertheless must, since the locking part projects laterally outwardly beyond the guide rail and the jaw in order to facilitate operation of the adjusting mechanism, be sufficiently strong that inadvertent disengagement during handling of the jaw cannot occur. Thus, an easy operation of the adjusting mechanism, either with an operating tool or by hand, is not possible.

Therefore, a basic purpose of the invention is to provide an adjusting mechanism of the above-mentioned type which requires minimal structural changes of the jaw and in which the unlocking of the jaw position can be done against the force of a very weak spring.

SUMMARY OF THE INVENTION

This purpose is attained inventively by the locking element and the spring being movably supported between the two guideways of the guide rail and being secured against movement longitudinally of the base plate of the jaw by means of at least two extensions of the base plate which, viewed in the longitudinal direction of the ski, are spaced from one another.

By arranging the locking element and the spring between the guideways of the guide rail, no structural changes of the guide rail are needed. The locking element and spring are completely covered, and there is no structural part which projects over the jaw. This measure makes it possible to select a spring with a very small force, since inadvertent unlocking is not possible.

A further characteristic of the invention consists in the locking element having a recess for receiving an operating tool which can be inserted through an opening in the base plate, for example a screwdriver, and having a further recess for receiving the portion of the spring which is supported thereon. This measure assures a simple operation of the adjusting mechanism without the existence of projecting and hindering structural parts. Also, the arrangement of the spring is very simple, since it has one end supported directly on a guideway of the guide rail and has the other end supported directly on the locking element.

A particularly advantageous development of the spring exists by inventively constructing same as an elastic element which is manufactured of a foam material, which, viewed in the top view, is I-shaped, and which is supported by means of its two ends which extend parallel to one another, one end extending into the recess on the locking element and the other end engaging one of the lateral guideways of the guide rail. By designing the spring as an elastic element, a particularly simple arrangement of the spring to the structural conditions is possible. The construction of the elastic element in the form of an I-shape assures a sufficient compressibility of same.

A further advantage of the invention consists in a stepping plate being releasably mountable on the base plate, which stepping plate covers in each position of the jaw relative to the ski-fixed guide rail the area of the guide rail projecting beyond the base plate and has above the opening in the base plate an opening for receiving the operating tool. An adjustment of the jaw can therefore occur in the case of a stepping plate which is mounted onto the base plate without the need for removal of the same during the adjusting operation.

BRIEF DESCRIPTION OF THE DRAWINGS

The invention will now be described in greater detail in connection with the drawings, which illustrate an exemplary embodiment.

In the drawings.

DETAILED DESCRIPTION

Figure 1:
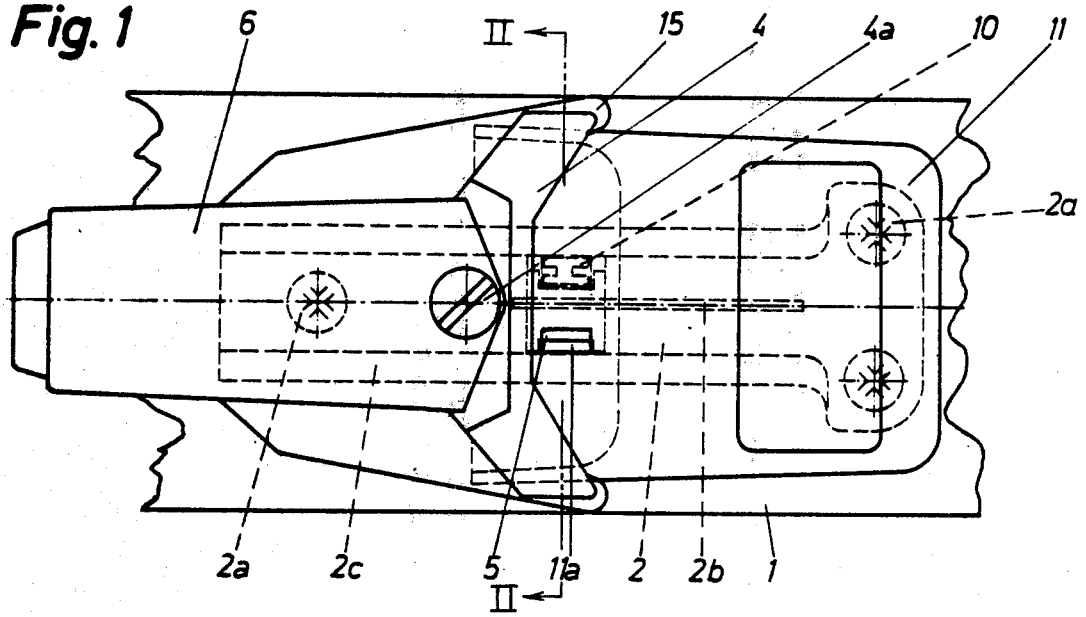
FIG. 1 is a top view of a jaw of a safety ski binding which embodies the inventive adjusting mechanism.
Figure 2:
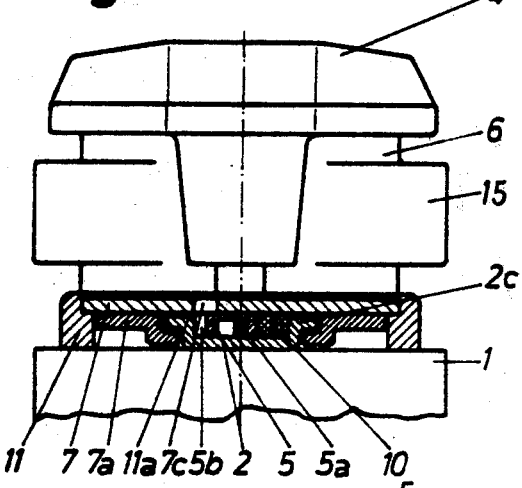
FIG. 2 is a sectional view taken along the line II—II of FIG. 1 and illustrates the jaw in a locked position.
Figure 8:
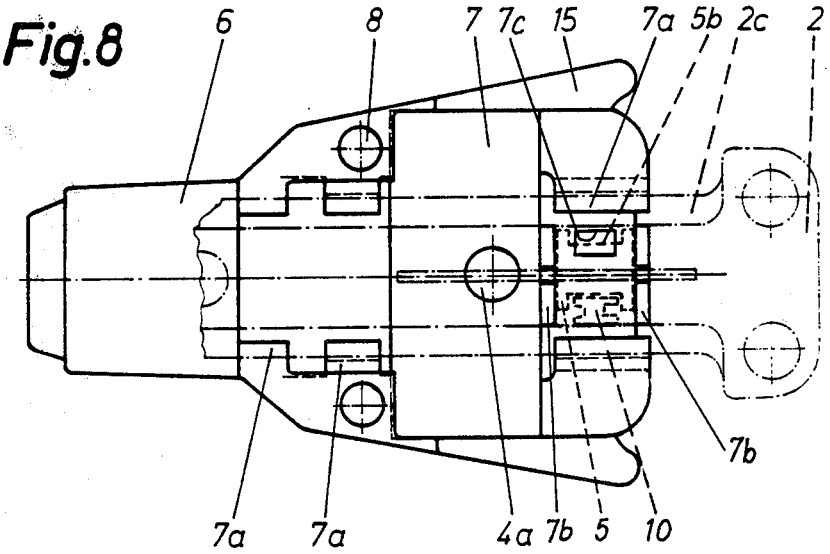
FIG. 8 is a bottom view of the jaw of FIG. 1.
Figure 9:
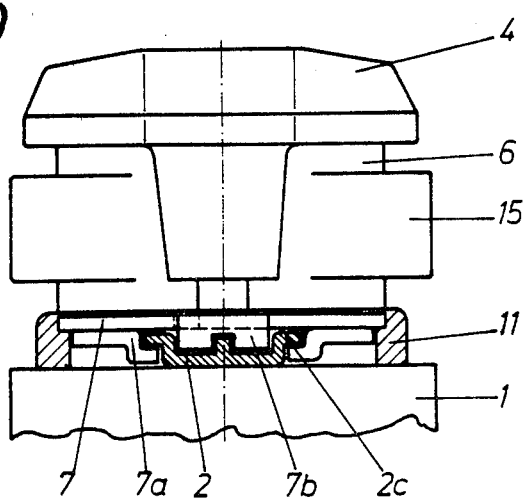
FIG. 9 is a sectional rear view of the jaw of FIG. 1.

Referring to FIGS. 1 and 2, a guide rail 2 is secured by means of screws 2*a* to a ski 1. The guide rail 2 extends longitudinally of the ski 1 and is symmetric with respect to the longitudinal axis of the ski 1, the lateral edges of the guide rail 2 which extend parallel to the side edges of the ski 1 being bent twice, namely upwardly and outwardly, in a conventional manner to form laterally spaced guideways 2*c* for the front jaw of a safety ski binding which is movably supported on the rail 2 in a manner described below. This front jaw may be designed as desired. In the present exemplary embodiment, the front jaw includes a conventional sole hold-down 4 which can be vertically adjusted in a conventional manner by means of an adjusting screw 4a for different height ski shoe soles, includes two conventional levers 15 which can be swung laterally outwardly about respective bolts 8 (FIG. 8) against the force of a spring (not illustrated), and includes a housing 6. These structural parts are arranged on a base plate 7, the construction of which can best be seen in FIGS. 2 and 8. The base plate 7 has at least two longitudinally spaced pairs of twice-bent and laterally spaced guide shoulders 7a, by means of which the base plate and jaw are slidably supported on the guide rail 2 for movement therealong. One pair of the guide shoulders 7a is provided near the end of the base plate 7 which faces the not illustrated heel holder, and thus assures an easy moving of the jaw onto the guide rail 2. When the jaw is moved onto the guide rail 2, a platelike locking element 5 (FIGS. 1 and 2) and an I-shaped spring 10 which biasses the locking element 5 are arranged between the two guideways 2c of the guide rail 2 and are movable relative to the guide rail 2. The locking element 5 is supported between one guideway 2c and an end of the spring 10, and the spring 10 has its other end supported on the second guideway 2c. The locking element 5 is furthermore secured against movement with respect to the jaw in directions longitudinal of the ski by spaced downward projections or extensions 7b (FIGS. 8 and 9) on the base plate 7, which extensions point toward the upper side of the ski, slidably engage opposite ends of the element 5, and are arranged near the end of the base plate 7 which faces the heel holder. Thus, parts of the base plate 7 and of the guide rail 2 form a receptacle for the locking element 5 and the spring 10. More specifically, the extensions 7b extend to and have edges adjacent the guideways 2c and the upper surface of the guide rail 2. Thus, the undersurface of the base plate 7, the upper surface of the guide rail 2, inwardly facing surfaces on the guideways 2c, and inwardly facing surfaces on the extensions 7b define a substantially closed guide channel or guide receptacle for the locking element 5. The locking element 5 has a thickness substantially equal to the vertical spacing between the upper surface of the guide rail 2 and the undersurface of the base plate 7, and slidably engages the upper surface of the guide rail 2, the undersurface of the base plate 7 and the inwardly facing surfaces on the extensions 7b.

The locking element 5 has a longitudinally extending recess in the underside thereof, in which a laterally offset tooth system 5a is arranged and extends parallel to the longitudinal extent of the guide rail 2. Respective recesses 5b and 5c are provided in the locking element 5 on opposite sides of the recess having the tooth system 5a. The two recesses 5b and 5c are each defined by approximately U-shaped walls of the element 5 in the exemplary embodiment. The spring 10 is an elastic element in the exemplary embodiment which is manufactured of a plastic material, for example a foam material, and is I-shaped. The elastic element 10 is supported by means of its two ends which extend parallel to one another, one such end engaging the bottom of the recess 5c of the locking element 5 and the other end engaging one of the lateral guideways 2c of the guide rail 2. The web of the elastic element 10 which connects the ends assures a sufficient compressability of the elastic element 10.

Figure 7:
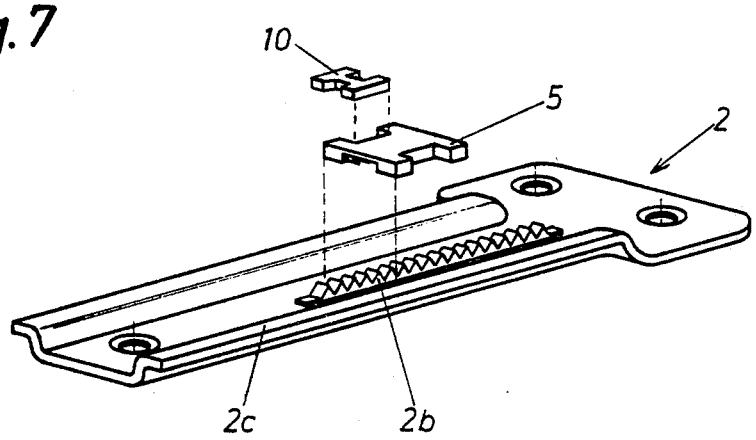
FIG. 7 is a perspective view of certain important structural components of the jaw of FIG. 1.

The guide rail 2 has, as can best be seen in FIG. 7, a tooth system which is a serrated strip 2b extending along its longitudinal axis. The length of the serrated strip 2b determines the amount of longitudinal adjustment of the jaw. Of course, the serrated strip 2b could alternatively be provided on either side of the centerline of the guide rail 2, and in this case the tooth system 5a could be arranged along the centerline of the locking element 5. The exemplary embodiment thus illustrates only one arrangement which is particularly space-saving and is structurally simple.

A stepping plate 11 can be removably mounted onto the base plate 7 in a conventional manner. The stepping plate 11 covers the guide rail 2 in every possible position of the jaw relative to the guide rail 2. Above the recess 5b of the locking element 5, in the base plate 7 and also in the stepping plate 11, respective rectangular openings 7c and 11a are provided, the widths of which are approximately twice the width of the recess 5b in the locking element 5. The dimensions of the openings 7c and 11a and of the recess 5b in the locking element 5 are chosen so that an operating tool 12, for example a conventional screwdriver, can easily be inserted therein.

Figure 3:
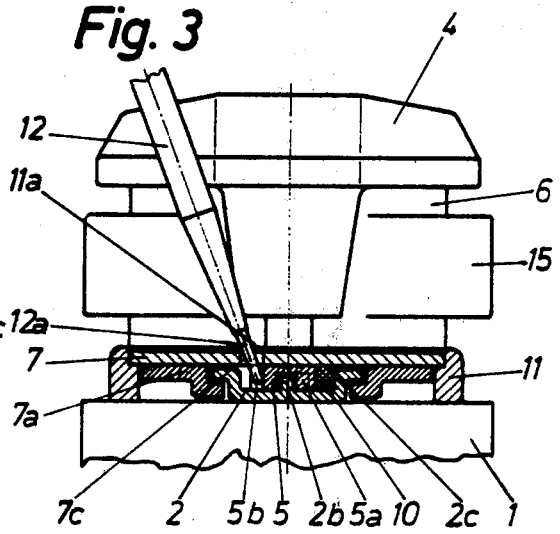
FIG. 3 is a sectional view similar to FIG. 2 which illustrates the jaw in an unlocked position.
Figure 4:
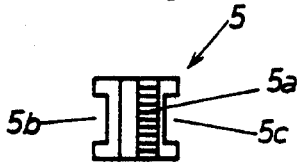
FIGS. 4, 5 and 6 are respectively top, end and perspective views of an inventive locking element which is a component of the jaw of FIG. 1.
Figure 5:
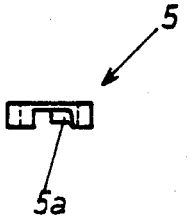
Figure 6:
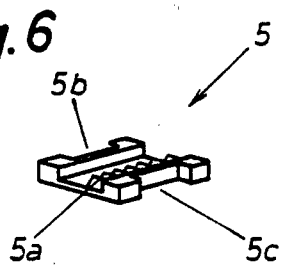

The operation of the inventive adjusting mechanism is very simple. In the locked position (FIG. 2) of the jaw, the tooth system 5a of the locking element 5 is engaged with a portion of the serrated strip 2b on the guide rail 2. If the jaw, for the purpose of effecting an adjustment to a different length ski shoe, is to be adjusted in the longitudinal direction of the ski 1, then the screwdriver 12 is inserted through the openings 11a and 7c in the stepping plate 11 and base plate 7 and into the recess 5b of the locking element 5. While supporting the blade 12a of the screwdriver 12 against the edge of the opening 11a of the stepping plate, the locking element 5 can be moved against the spring force of the elastic element 10 in a direction laterally of the ski 1, whereby the tooth system 5a of the locking element 5 slides laterally with respect to the serrated strip 2b of the guide rail 2 until the engagement of the tooth system 5a with the serrated strip 2b is cancelled, as shown in FIG. 3. It is now possible to move the jaw longitudinally of the rail to a desired position with one hand while simultaneously holding the screwdriver 12 with the other hand, and to then lock the jaw in this position by removing the screwdriver 12. The elastic element 10 then urges the locking element 5 back into the position in which the locking element 5 engages the guideway 2c and in which the tooth system 5a thereon engages the serrated strip 2b.

The inventive adjusting mechanism is particularly advantageous because minimal structural changes of a given jaw are required to add it. Furthermore, the spring and the locking element are completely covered and are thus protected against corrosion and dirt. There are also no projecting structural parts. Thus, the adjusting mechanism is protected against inadvertent operation and the spring force can be relatively small. Also, removal of the stepping plate during the adjusting operation is not necessary. The arrangement of the serrated strip 2b on the guide rail 2 and of the tooth system 5a on the locking element 5 which is movable transversely of the ski permits a so-called fine locking, namely, the jaw can be adjusted longitudinally in a very precise manner.

The invention is not limited to the illustrated exemplary embodiment. Variations or modifications thereof, including the rearrangement of parts, are possible without leaving the scope of the protection of the claims. The elastic element, which in the present exemplary embodiment is manufactured of a plastic material, could be replaced by a leaf spring or by one or more helical springs. Also, it would be conceivable to provide the locking element with an extension which projects across the base plate in the direction of the heel holder and to effect movement of the locking element with this extension. For this, however, the stepping plate would have to be removed. Basically, it is possible to incorporate into virtually all bindings which are available on the market the inventive adjusting mechanism.

The embodiments of the invention in which an exclusive property or privilege is claimed are defined as follows:

1. A mechanism for adjusting the position of a ski binding jaw on a ski, comprising a guide rail adapted to be secured to the ski and having laterally spaced guideways which extend longitudinally of the ski, said ski binding jaw being arranged on a base plate and said base plate being supported on said laterally spaced guideways of said guide rail for movement longitudinally of the ski, said guide rail having at least one longitudinally extending serrated strip thereon which can releasably engage a tooth system provided on a locking element which is supported for movement transversely of the ski and is biased by a spring, said spring having one end supported on said locking element, said locking element and spring being disposed between said guideways of said guide rail and being secured against movement relative to said base plate in a direction longitudinally of the ski by two extensions which are provided on said base plate and, viewed in the longitudinal direction of the ski, are spaced from one another, said locking element having a recess for receiving an operating tool which can be inserted through an opening in said base plate, and said locking element having a further recess for receiving said one end of said spring.

2. The mechanism according to claim 1, wherein said spring is an elastic element which, viewed in a top view, is I-shaped and has two ends which extend parallel to one another, said one end being disposed in said further recess of said locking element and the other end of said elastic element engaging one of said guideways of said guide rail.

3. The mechanism according to claim 1, including a stepping plate which can be releasably mounted on said base plate, which covers a region of said guide rail which projects beyond said base plate in every position of said ski binding jaw relative to said guide rail, and which has, above said opening in said base plate, an opening for receiving said operating tool.

4. A mechanism for adjusting the position of a ski binding jaw on a ski, comprising a guide rail adapted to be secured to the ski and having laterally spaced guideways which extend longitudinally of the ski, a base plate which is supported on said laterally spaced guideways of said guide rail for movement longitudinally of the ski and has said ski binding jaw supported thereon, a platelike locking element, and a platelike resilient member, said guide rail having at least one longitudinally extending serrated strip thereon which can releasably engage a tooth system provided on said locking element, said platelike locking element being supported between said base plate and said guide rail for movement transversely of the ski and being biased by said resilient member, said resilient member having one end supported on said locking element, said locking element and said resilient member lying substantially in a common plane, being disposed between said guideways of said guide rail and being secured against movement with respect to said base plate longitudinally of the ski by two extensions which are provided on said base plate and are spaced from one another in a direction longitudinally of the ski.

5. The mechanism according to claim 4, wherein said locking element has a first recess adapted to receive an operating tool which can be inserted through an opening provided in the base plate, and wherein said locking element has a further recess for receiving said one end of said resilient member.

6. The mechanism according to claim 5, wherein said resilient member is an elastic element which, viewed in a top view, is I-shaped, the ends thereof extending generally parallel to one another, said one end being disposed in said further recess of said locking element and the other end engaging one of said guideways of said guide rail.

7. The adjusting mechanism according to claim 5, including a stepping plate which can be releasably mounted on said base plate, covers a region of said guide rail which projects beyond said base plate in every position of the jaw relative to said guide rail, and has, aligned with said opening in said base plate, an opening for the operating tool.

8. A mechanism for adjusting the position of a ski binding jaw on a ski, comprising:

a guide rail adapted to be secured to the ski;

a base plate supported on said guide rail for reciprocal movement in a first direction substantially longitudinally of the ski, said base plate having said ski binding jaw supported thereon and having an undersurface which is spaced vertically from an upper surface of said guide rail, one of said guide rail and said base plate having laterally spaced first and second guideways thereon which extend in said first direction and project toward the other thereof, and the other of said base plate and guide rail being cooperable with said guideways for effecting said movable support of said base plate on said guide rail; and one of said base plate and said guide rail having a serrated strip thereon which is between said guideways and extends in said first direction, and the other of said base plate and guide rail having means defining first and second opposed, longitudinally spaced surfaces between said guideways; said undersurface of said base plate, said upper surface of said guide rail, said guideways, and said first and second surfaces defining a guide channel;

a platelike locking element supported generally horizontally in said guide channel for movement in a second direction transversely of said first direction between first and second positions, said locking element slidably engaging said undersurface of said base plate, said upper surface of said guide rail and said first and second surfaces; said first and second surfaces preventing movement of said locking element in said first direction relative to the one of said guide rail and said base plate having said first and second surfaces thereon; said locking element having a tooth which operatively engages said serrated strip when said locking element is in said first position and is free of engagement with said serrated strip when said locking element is in said second position; said first guideway engaging a side of said locking element when said locking element is in said first position so as to prevent movement of said locking element past said first position; and resilient means yieldably urging said locking element towards said first position.

9. The mechanism according to claim 8, wherein said resilient means includes a flat resilient element disposed within said guide channel and having two ends, one said end engaging said locking element and the other end being supported on said second guideway, movement of said locking element from said first position to said second position effecting elastic deformation of said resilient element.

10. The mechanism according to claim 9, wherein said resilient element is substantially I-shaped and has two substantially parallel end portions which extend substantially in said first direction and are connected by a web portion which extends substantially in said second direction.

11. The mechanism according to claim 10, wherein said resilient element is made of a foam material, and including means defining a recess in a side of said locking element, said one end of said resilient element being disposed in said recess in said locking element and said locking element and resilient member being substantially coplanar.

12. The mechanism according to claim 8, wherein said locking element has a recess which extends in said first direction and is provided in a side thereof which faces said serrated strip, a portion of said serrated strip being disposed in said recess in all operational positions of said locking element, and wherein said tooth is provided in said recess, said recess having a width in said second direction which is greater than the combined widths of said tooth and said serrated strip in said second direction.

13. The mechanism according to claim 12, wherein said locking element has a first recess on the side thereof which engages said first guideway and has a second recess on the opposite side thereof.

14. The mechanism according to claim 8, wherein said guideways and said serrated strip are provided on said guide rail, and wherein said base plate has longitudinally spaced downward projections on said undersurface thereof and between said guideways, each said projection having a respective one of said first and second surfaces thereon.

15. The mechanism according to claim 14, wherein said locking element has a recess therein, and wherein said base plate has an opening therethrough which communicates with said guide channel, said recess in said locking element being substantially aligned with said opening in said base plate in all operational positions of said locking element.

16. The mechanism according to claim 14, wherein said projections each extend to locations adjacent said guideways and said upper surface of said guide rail so that said guide channel is a substantially closed guide receptacle, said locking element being disposed entirely within said guide receptacle in all operational positions thereof.

* * * * *